US012392532B2

(12) United States Patent
Talhouarn et al.

(10) Patent No.: US 12,392,532 B2
(45) Date of Patent: Aug. 19, 2025

(54) ACCUMULATOR HEAT EXCHANGER

(71) Applicant: Carrier Corporation, Palm Beach Gardens, FL (US)

(72) Inventors: Fabien Talhouarn, Franqueville Saint Pierre (FR); Benoit Bombard, Franqueville Saint Pierre (FR); Mark Hooker, Franqueville Saint Pierre (FR); David Vericel, Franqueville Saint Pierre (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 144 days.

(21) Appl. No.: 18/330,617

(22) Filed: Jun. 7, 2023

(65) Prior Publication Data

US 2023/0392839 A1 Dec. 7, 2023

(30) Foreign Application Priority Data

Jun. 7, 2022 (EP) ..... 22177677

(51) Int. Cl.
*F25B 43/00* (2006.01)
*F25B 40/06* (2006.01)

(52) U.S. Cl.
CPC ..... *F25B 43/006* (2013.01); *F25B 40/06* (2013.01)

(58) Field of Classification Search
CPC ..... F25B 43/006; F25B 2400/051; F25B 2400/23
See application file for complete search history.

(56) References Cited

U.S. PATENT DOCUMENTS 4,785,878 A * 11/1988 Honkajarvi ..... F28D 7/0033 165/DIG. 451
5,651,265 A * 7/1997 Grenier ..... F25B 13/00 165/45
7,690,219 B2 4/2010 Suzuki et al.
7,918,107 B2 4/2011 Klotten et al.
8,567,212 B2 10/2013 Guitari
9,279,606 B2 3/2016 Kim
(Continued)

FOREIGN PATENT DOCUMENTS

CN 105805990 A 7/2016
DE 102008028851 A1 12/2009
(Continued)

OTHER PUBLICATIONS

Extended European Search Report received for EP Application No. 22177677.6, mailed on Nov. 8, 2022, 07 Pages.

*Primary Examiner* — David J Teitelbaum
(74) *Attorney, Agent, or Firm* — Souad Hakim

(57) ABSTRACT

An accumulator heat exchanger comprising an accumulator vessel with an internal volume for accumulation of refrigerant fluid. The accumulator vessel has a first inlet conduit for gaseous refrigerant and a first outlet conduit for superheated gaseous refrigerant; a heat exchange coil disposed within the accumulator vessel. The heat exchange coil has a second inlet conduit for subcooled refrigerant fluid and a second outlet conduit for subcooled refrigerant fluid. The second inlet conduit and second outlet conduit provide an inlet and outlet flow path for the heat exchange coil. A separator plate covers a cross-section of the inner volume of the heat exchange coil.

14 Claims, 7 Drawing Sheets

(56) References Cited

U.S. PATENT DOCUMENTS

| | | | | |
|---|---|---|---|---|
| 11,566,823 | B1 * | 1/2023 | Feria | F25B 30/02 |
| 2002/0078702 | A1 * | 6/2002 | Makizono | F28D 7/04 62/271 |
| 2003/0024266 | A1 * | 2/2003 | Zhang | F25B 43/006 62/503 |
| 2008/0041093 | A1 | 2/2008 | Sung et al. | |
| 2015/0096311 | A1 * | 4/2015 | Johnson | F25B 39/00 62/89 |
| 2015/0345844 | A1 * | 12/2015 | Köster | F25B 31/004 62/512 |
| 2023/0243559 | A1 * | 8/2023 | Tian | F25B 43/00 62/498 |

FOREIGN PATENT DOCUMENTS

| | | | |
|---|---|---|---|
| EP | 1418395 | A2 | 5/2004 |
| EP | 1640676 | B1 | 10/2007 |
| EP | 1890096 | A2 | 2/2008 |
| EP | 2206971 | A2 | 7/2010 |
| EP | 2530409 | A2 | 12/2012 |
| EP | 2963362 | A1 | 1/2016 |
| EP | 1992892 | B1 | 11/2016 |
| EP | 3255361 | B1 | 12/2018 |
| KR | 100784612 | B1 | 12/2007 |
| KR | 20080069803 | A | 7/2008 |
| KR | 20090110647 | A | 10/2009 |
| WO | 2017208783 | A1 | 12/2017 |

* cited by examiner

ACCUMULATOR HEAT EXCHANGER

CROSS REFERENCE TO RELATED APPLICATIONS

This application claims priority to European Patent Application No. 22177677.6 filed on Jun. 7, 2022.

BACKGROUND

The present disclosure relates to an accumulator heat exchanger and a refrigeration system comprising an accumulator heat exchanger. The present disclosure also relates to a method of heat exchange using an accumulator heat exchanger.

Accumulators are used in refrigeration systems to collect liquid refrigerant and thus prevent liquid refrigerant from passing into the compressor where it can cause damage. Heat exchangers are used in refrigeration systems in order to control the temperature of the refrigerant. It is known to provide accumulator heat exchangers which combine the functions of accumulators and heat exchangers. Accumulator heat exchangers can reduce the temperature of a first refrigerant flow before it enters an evaporator in order to increase its cooling capacity, and simultaneously increase the temperature of a second refrigerant flow before it enters a compressor in order to promote the formation of gaseous refrigerant from liquid refrigerant. Heat can hence be extracted from the first refrigerant flow to form subcooled refrigerant used within a first portion of the refrigeration system, and that heat can be usefully used for heating the second refrigerant flow to form superheated refrigerant used within a second portion of the refrigeration system.

It is desirable to increase the heat exchange between the two refrigerant flows in order to further improve cooling capacity of the refrigeration system and the overall efficiency of the refrigeration system.

It is known to increase the subcooling of the first refrigerant flow using an additional heat exchanger, such as a liquid vapour heat exchanger or a brazed plate heat exchanger, once the refrigerant exits the accumulator and before entering the evaporator. However, integration of the heat exchanger within the refrigeration system can be complicated and the additional component results in a higher cost and the refrigeration system having a larger volume.

It is therefore also desirable to increase the heat exchange between the two refrigerant flows without increasing the complexity of the refrigeration system and without causing a substantial increase in the space required for the refrigeration system.

SUMMARY

According to a first aspect, there is provided an accumulator heat exchanger for use within a refrigeration system, the accumulator heat exchanger comprising: an accumulator vessel with an internal volume for accumulation of refrigerant fluid, wherein the accumulator vessel has an axial extent and a radial extent; a first inlet conduit for gaseous refrigerant and a first outlet conduit for superheated gaseous refrigerant; a heat exchange coil disposed within the accumulator vessel so as to provide an axially extending outer gap between an inner surface of the accumulator vessel and a radially outer surface of the heat exchange coil, wherein the heat exchange coil encloses an axially extending inner volume of the heat exchange coil; a second inlet conduit for subcooled refrigerant fluid and a second outlet conduit for subcooled refrigerant fluid, wherein the second inlet conduit and second outlet conduit provide an inlet and outlet flow path for the heat exchange coil; and a separator plate covering a cross-section of the inner volume of the heat exchange coil without interrupting the outer gap, wherein: the first inlet conduit extends from outside of the accumulator vessel into the accumulator vessel, through the separator plate and terminates at an internal outlet within the inner volume of the heat exchange coil on a second side of the separator plate, the first outlet conduit has an internal inlet that is disposed within the vessel outside of the inner volume of the heat exchange coil and on the opposite side of the separator plate to the internal outlet of the first inlet conduit, wherein the first outlet conduit extends from this internal inlet through the separator plate and through the inner volume of the heat exchange coil and to the outside of the accumulator vessel.

DETAILED DESCRIPTION

Figure 1:
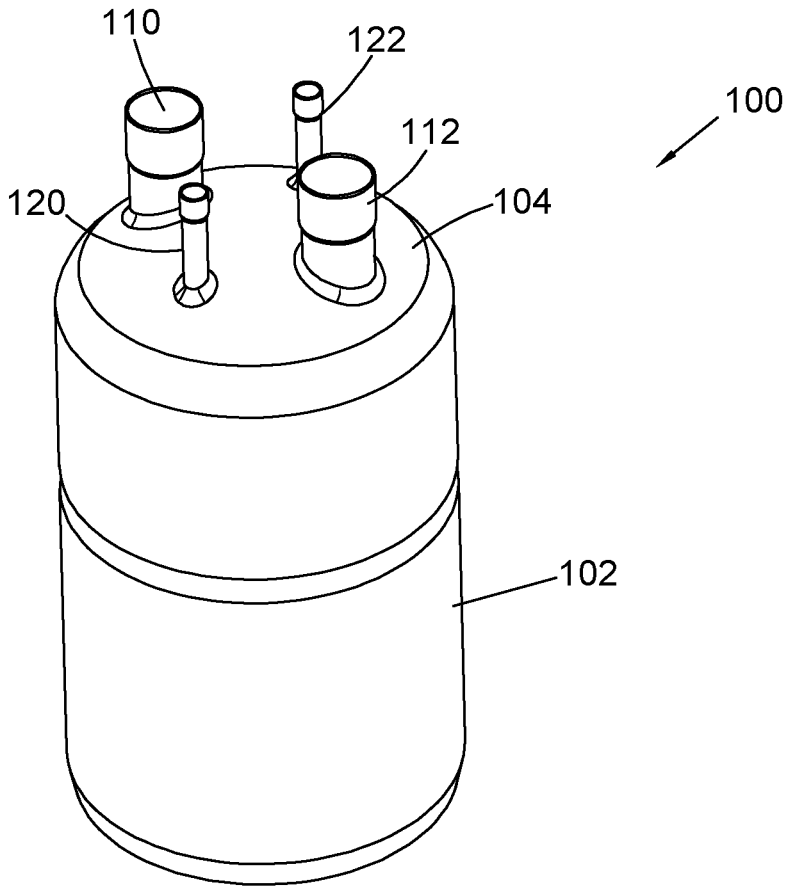
FIG. 1 shows a perspective external view of an accumulator heat exchanger.

According to a first aspect, there is provided an accumulator heat exchanger for use within a refrigeration system, the accumulator heat exchanger comprising: an accumulator vessel with an internal volume for accumulation of refrigerant fluid, wherein the accumulator vessel has an axial extent and a radial extent; a first inlet conduit for gaseous refrigerant and a first outlet conduit for superheated gaseous refrigerant; a heat exchange coil disposed within the accumulator vessel so as to provide an axially extending outer gap between an inner surface of the accumulator vessel and a radially outer surface of the heat exchange coil, wherein the heat exchange coil encloses an axially extending inner volume of the heat exchange coil; a second inlet conduit for subcooled refrigerant fluid and a second outlet conduit for subcooled refrigerant fluid, wherein the second inlet conduit and second outlet conduit provide an inlet and outlet flow path for the heat exchange coil; and a separator plate covering a cross-section of the inner volume of the heat exchange coil without interrupting the outer gap, wherein: the first inlet conduit extends from outside of the accumulator vessel into the accumulator vessel, through the separator plate and terminates at an internal outlet within the inner volume of the heat exchange coil on a second side of the separator plate, the first outlet conduit has an internal inlet that is disposed within the vessel outside of the inner volume of the heat exchange coil and on the opposite side of the separator plate to the internal outlet of the first inlet conduit, wherein the first outlet conduit extends from this internal inlet through the separator plate and through the inner volume of the heat exchange coil and to the outside of the accumulator vessel.

The accumulator vessel may be cylindrical, the axial and radial extent of the accumulator vessel following the axial and radial dimensions of the cylinder respectively.

The heat exchange coil may be a helical coil, thereby having a cylindrical outermost surface and an axially extending inner volume with a circular cross section. The heat exchange coil is positioned within the accumulator vessel to produce an outer gap through which refrigerant within the accumulator vessel can pass. The outer gap thereby provides a flow path for refrigerant between a volume outside of the inner volume of the heat exchange coil at one end of the accumulator vessel to a volume outside of the inner volume of the heat exchange coil at the other end of the accumulator vessel. The outer gap extends from the inner perimeter of the accumulator vessel to the radially outer perimeter of the heat exchange coil. In examples in which the accumulator vessel and the heat exchange coil have cylindrical forms, the outer gap will have the form of an annular gap extending between the inner and outer circumferences of the accumulator vessel and heat exchange coil respectively.

The separator plate is provided to cover a cross-section of the inner volume of the heat exchange coil adjacent an axial end of the heat exchange coil. The separator plate is provided so that, in use, a reduced volume of refrigerant flows from within the inner volume of the heat exchange coil to outside of the inner volume of the heat exchange coil by passing through the axial end of the heat exchange coil adjacent the separator plate. The length of the refrigerant flow path within the accumulator heat exchanger is therefore increased without increasing the volume of the accumulator vessel. In some examples, the separator plate may seal the first end of the heat exchange coil such that, in use, refrigerant is prevented from passing from the inner volume of the heat exchange coil through the axial end of the heat exchange coil adjacent the separator plate.

The separator plate does not interrupt the outer gap between the inner surface of the accumulator vessel and a radially outer surface of the high pressure refrigerant coil meaning that there is a gap between the separator plate and the accumulator vessel along substantially the entire circumference of the separator plate. Hence the separator plate does not touch the inner surface of the accumulator vessel along substantially all of its circumference. In some examples design constraints and other components may result in brief interruptions of the outer gap.

In some examples, the separator plate is provided outside of the inner volume of the heat exchange coil, and in contact with the axially outer most surface of the axially outer most winding of the heat exchange coil. The separator plate therefore partitions the inner volume of the heat exchange coil from the volume of the accumulator outside of the inner volume of the heat exchange coil. The separator plate may extend beyond the radial extent of the windings of the heat exchange coil, or may extend to the same radial extent of the windings of the heat exchange coil.

In other examples, the separator plate is provided within the inner volume of the heat exchange coil and in contact with a radially inner surface of the heat exchange coil.

The first inlet conduit extends through the separator plate, with little or no gap between the first conduit and the separator plate. The first inlet conduit terminates at an outlet internal to the accumulator vessel and disposed within the inner volume of the heat exchange coil. Such a configuration means that, in use, a reduced volume of refrigerant flows from the outlet of the first inlet conduit to the inlet of the first outlet conduit without passing through the outer gap, or, when the separator plate seals the axial end of the heat exchange coil refrigerant is prevented from flowing from the outlet of the first inlet conduit to the inlet of the first outlet conduit without passing through the outer gap.

A length of the first outlet conduit that extends within the inner volume of the heat exchange coil may be disposed adjacent to the heat exchange coil.

The first outlet conduit is therefore disposed in the radially outer region of the inner volume of the heat exchange coil, therefore it is closer to the windings of the heat exchange coil than the axis of the coil. The close proximity between the first outlet conduit and the heat exchange coil promotes a high heat exchange rate between the refrigerant respectively therein.

The first outlet conduit may comprise a U turn in order to extend axially through the inner volume of the heat exchange coil in opposite first and second directions.

The first outlet conduit therefore changes direction within the accumulator vessel in order to extend the length of the conduit within the accumulator vessel, with one part of the first outlet conduit extending in the first direction and another part extending in a second direction, typically parallel to the first direction. The first outlet conduit therefore extends adjacent the heat exchange coil along an increased length. In use, heat exchange between the refrigerant within the heat exchange coil and the first outlet conduit is therefore increased. The first and second directions are aligned with the axis of the heat exchange coil. A U turn can be any combination of turns that results in the conduit turning back on itself so as to flow initially in a first direction and then in an opposite second direction. The length of the refrigerant flow path within the accumulator heat exchanger is therefore increased without increasing the volume of the accumulator vessel.

The U turn may be disposed outside of the inner volume of the heat exchange coil.

The first outlet conduit therefore extends from outside of the inner volume of the heat exchange coil, through the separator plate, axially through the inner volume of the heat exchange coil in the first direction, outside of the inner volume of the heat exchange coil, axially through the inner volume of the heat exchange coil in the second direction. When only one U turn is present, the first outlet conduit subsequently extends through the separator plate and outside of the accumulator vessel. The length of the path for heat exchange between the subcooled refrigerant in the heat exchange coil and the superheated refrigerant in the outlet conduit is therefore increased by extending through the entire length of the coil.

The first outlet conduit comprising a U turn may also comprise an oil port in order to supply refrigerant oil to the flow of gaseous refrigerant within the first outlet conduit. By mixing the gaseous refrigerant with refrigerant oil within the accumulator, a mixture of gaseous refrigerant and refrigerant oil can be provided to a compressor. This ensures the compressor is lubricated via the refrigerant oil whilst preventing liquid refrigerant from entering the compressor. The oil port is able to meter the addition of refrigerant oil to the gaseous refrigerant to ensure a suitable mixture is achieved for correct lubrication of the compressor. The U turn in the first outlet conduit allows for first outlet conduit and the oil port to reside within an accumulation of the refrigerant oil. The U turn of the first outlet conduit is therefore provided so that during the expected use of the accumulator the U turn is disposed towards the base of accumulator vessel.

The first inlet conduit and the first outlet conduit may enter and exit the accumulator vessel, respectively, through a first cap of the accumulator vessel.

The first cap may be disposed at an axial end of the accumulator vessel. The cap advantageously remains sealed where the conduits pass through it.

The second inlet conduit and second outlet conduit may also enter and exit the accumulator vessel, respectively, through the first cap of the accumulator vessel. Alternatively, the second inlet conduit and the second outlet conduit may enter and exit the accumulator vessel, respectively, through a second cap of the accumulator vessel disposed at the opposite axial end of the accumulator vessel. If the second outlet conduit exits the accumulator vessel at the same axial cap as the second inlet conduit enters the accumulator vessel, either of the second inlet conduit or second outlet conduit extends through the inner volume of the heat exchange coil to the respective cap.

In alternative examples, where the first outlet conduit does not comprise a U turn, or comprises an even number of U turns, the first inlet conduit enters the accumulator vessel through the first cap and the first outlet conduit exits the accumulator vessel through a second cap of the accumulator vessel at the opposite axial end of the accumulator vessel. Similarly, some examples include the second inlet conduit and the second outlet conduit entering and exiting the accumulator vessel, respectively, through caps at opposite axial ends of the accumulator vessel.

The pitch of the heat exchange coil may be such that adjacent windings are in contact.

The heat exchange coil may for example be a circular helical coil. The pitch of the heat exchange coil may be constant or may vary along the axial length of the coil. Where there is contact between adjacent windings of the heat exchange coil, there is no route for any meaningful flow of refrigerant within the accumulator vessel to pass through the axially and circumferentially extending surface of the coil. Therefore, by providing the coil with regions of contact between adjacent windings, when in use the volume of refrigerant passing from within the inner volume of the coil to the outer gap without first exiting the inner volume of the heat exchange coil is reduced. In some embodiments, adjacent windings are in sufficient, sustained contact such that there is no route for refrigerant to pass from within the inner volume of the coil to the outer gap without first exiting the inner volume of the heat exchange coil. In some implementations the adjacent windings are sealed together in order to fully prevent flow between adjacent windings. Alternatively, the adjacent windings may be in contact without an added sealing mechanism, such that a small amount of leakage may occur but without meaningful volumes flowing between the windings. Another possibility is for the coil windings to be spaced apart with added barriers between the windings to restrict and/or prevent refrigerant flow between the inner volume and the outer gap. A primary flow path for at least the majority of the refrigerant therefore extends through the inner volume of the heat exchange coil and exits the inner volume at the axial end opposite that with the separator plate. The flow path for refrigerant then extends along the outer gap towards the first outlet conduit inlet. The length of the flow path for refrigerant within the accumulator vessel is therefore increased so that in use heat exchange between the refrigerant in the accumulator vessel and the subcooled refrigerant in the heat exchange coil is also increased.

The separator plate may be brazed to the heat exchange coil.

The separator plate is therefore bonded to the heat exchange coil. The separator plate may be brazed to the heat exchange coil along the circumference of the separator plate or only at certain points along the circumference of the separator plate. Where the separator plate is brazed along the entire circumference, a seal is therefore provided between the separator plate and the heat exchange coil so that there is no route for refrigerant to pass between the separator plate and the heat exchange coil.

The second inlet conduit may connect to the heat exchange coil at the axial end of the coil adjacent the separator plate. In use, the subcooled refrigerant flows through the coil towards the axial end of the coil opposite that adjacent the separator plate.

Alternatively, the second inlet conduit may connect to the heat exchange coil at the axial end of the coil opposite that adjacent the separator plate. In use, subcooled refrigerant flows through the coil towards the axial end adjacent the separator plate.

According to another aspect, there is provided a refrigeration system comprising; an accumulator heat exchanger as in the first aspect and optionally including other features as discussed above, a compressor, an evaporator, an expansion valve, and a condenser, wherein the first inlet conduit and the first outlet conduit are positioned between the evaporator and the compressor such that a first refrigerant flow path extends sequentially from the evaporator to the first inlet conduit, to the first outlet conduit to the compressor, and the second inlet conduit and second outlet conduit are positioned between the condenser and the expansion valve such that a second refrigerant flow path extends sequentially from the condenser to the second inlet conduit, to the second outlet conduit and to the expansion valve.

In some embodiments, the first refrigerant flow path may extend directly from the evaporator to the first inlet conduit and/or directly from the first outlet conduit to the compressor, that is, without passing through another component in between, besides the connecting refrigerant lines or pipes. In other embodiments, the first refrigerant flow path may extend through additional components in between the evaporator and the first inlet conduit, and/or additional components between the first outlet conduit and the compressor, but will maintain the sequence recited above with respect to the evaporator, first inlet conduit, first outlet conduit and compressor.

In some embodiments, the second refrigerant flow path may extend directly from the condenser to the second inlet conduit and/or directly from the second outlet conduit to the expansion valve, that is, without passing through another component in between, besides the connecting refrigerant lines or pipes. In other embodiments, the second refrigerant flow path may extend through additional components in between the condenser and the second inlet conduit, and/or additional components between the second outlet conduit and the expansion valve, but will maintain the sequence recited above with respect to the condenser, second inlet conduit, second outlet conduit and expansion valve.

The first inlet conduit may be directly connected to the evaporator.

A flow path is therefore provided between the evaporator and the first inlet conduit, and besides the connecting refrigerant lines or pipes, this flow path does not extend through any additional component in between the evaporator and first inlet conduit.

The first outlet conduit may be directly connected to the compressor.

A flow path is therefore provided between the first outlet conduit and the compressor, and besides the connecting refrigerant lines or pipes, this flow path does not extend through any additional component in between the first outlet conduit and the compressor.

The refrigeration system may be suitable for use in a transportation application. For example, the refrigeration system may be suitable for use in a refrigerated vehicle and/or trailer. Such refrigerated vehicles and trailers are commonly used to transport perishable goods in a cold chain distribution system. The refrigeration system may be mounted to the vehicle or to the trailer in operative association with a cargo space within the vehicle or trailer for maintaining a controlled temperature environment within the cargo space.

The refrigeration system may be suitable for use in HVAC systems or air conditioning systems which can be installed in buildings, vehicles, or the like.

According to another aspect, there is provided a method of heat exchange using an accumulator heat exchanger as described above, the method comprising, simultaneously supplying gaseous refrigerant to the first inlet conduit, and supplying subcooled liquid refrigerant to the second inlet conduit.

The first inlet conduit thereby introduces gaseous refrigerant into the internal volume of the accumulator vessel. The second inlet conduit introduces subcooled refrigerant into the heat exchange coil within the accumulator vessel.

A mixture of gaseous refrigerant and liquid refrigerant may enter the accumulator vessel through the first inlet conduit. Liquid refrigerant may accumulate in a pool within the accumulator vessel and may be periodically vaporized from the accumulator vessel. Gaseous refrigerant may accumulate throughout the vessel, and may generally flow from an outlet of the first inlet conduit to the inlet of the first outlet conduit.

The general flow path of the refrigerant exiting the first inlet conduit will be to flow through the internal volume of the heat exchange coil and exit the internal volume at an axial end of the coil opposite the axial end adjacent the separator plate, reverse direction and flow along the length of the accumulator vessel through the outer gap, and flow into the internal inlet of the first inlet conduit disposed on the opposite side of the separator plate to the outlet of the first inlet conduit.

The gaseous refrigerant will become superheated gaseous refrigerant as it travels through the accumulator vessel due to heat exchange with subcooled refrigerant in the heat exchange coil. Superheated refrigerant is at a temperature greater than the dew vapor point of the refrigerant. Subcooled refrigerant is at a temperature lower than the bubble (liquid) point of the refrigerant.

The gaseous refrigerant within the first inlet conduit, the accumulator vessel and the first outlet conduit is at a lower pressure than the refrigerant within the second inlet conduit, heat exchange coil and the second outlet conduit. As a result, the dew vapour point of the refrigerant within the first inlet conduit, the accumulator vessel and the first outlet conduit will be lower than that of the refrigerant within the second inlet conduit, heat exchange coil and the second outlet conduit. Consequently, the gaseous refrigerant can be at a lower temperature than the subcooled liquid refrigerant. Heat exchange therefore takes place via heat transfer from the subcooled liquid refrigerant to the superheated refrigerant. The accumulator heat exchanger therefore acts to further cool the subcooled refrigerant and to further heat the gaseous refrigerant to form a superheated gaseous refrigerant. As a result, evaporation of the refrigerant supplied via the first inlet conduit is promoted and the volume of liquid refrigerant accumulation in the accumulator is reduced. The subcooled refrigerant leaving the accumulator heat exchanger also has a greater cooling capacity as a result of its decreased temperature.

The accumulator heat exchanger may be part of a refrigeration system, wherein the refrigeration system comprises; a compressor, an evaporator, an expansion valve, and a condenser, and the method of heat exchange comprises; supplying refrigerant from the evaporator to the first inlet conduit, supplying superheated gaseous refrigerant from the first outlet conduit to the compressor, supplying subcooled liquid refrigerant from the condenser to the second inlet conduit, and supplying subcooled liquid refrigerant from the second outlet conduit to the expansion valve.

In some embodiments, the refrigerant may be supplied directly from the evaporator to the first inlet conduit and/or the superheated gaseous refrigerant may be supplied directly from the first outlet conduit to the compressor, that is, without passing through another component in between. In other embodiments, the refrigerant may flow through additional components in between the evaporator and the first inlet conduit, and/or additional components between the first outlet conduit and the compressor, but will maintain the sequence recited above with respect to the evaporator, first inlet conduit, first outlet conduit and compressor.

In some embodiments, subcooled refrigerant may be supplied directly from the condenser to the second inlet conduit and/or may be supplied directly from the second outlet conduit to the expansion valve, that is, without passing through another component in between. In other embodiments, subcooled refrigerant may flow through additional components in between the condenser and the second inlet conduit, and/or additional components between the second outlet conduit and the expansion valve, but will maintain the sequence recited above with respect to the condenser, second inlet conduit, second outlet conduit and expansion valve.

Gaseous refrigerant may be supplied to the first inlet conduit directly from the evaporator.

Gaseous refrigerant is thereby supplied to the accumulator vessel from the evaporator without the gaseous refrigerant entering an additional component between the evaporator and the first inlet conduit. A combination of gaseous refrigerant and liquid refrigerant may be provided to the accumulator vessel from the evaporator through the first inlet conduit.

Superheated gaseous refrigerant may be supplied directly from the first outlet conduit to the compressor.

Superheated gaseous refrigerant is therefore provided to the compressor from the accumulator vessel without passing through an additional component of the refrigeration system between the first outlet conduit and the compressor. Any liquid refrigerant introduced into the accumulator vessel will pool within the vessel and will not flow through the first outlet conduit to the compressor.

As seen in FIG. 1, an accumulator heat exchanger 100 comprises an accumulator vessel 102 having an internal volume 108 (see FIG. 2) for accumulation of refrigerant. The accumulator vessel 102 of FIG. 1 is broadly cylindrical having an axial extent and a radial extent. A cap 104 at an axial end of the accumulator vessel provides a slightly domed end to the accumulator vessel 102. A first inlet conduit 110 and a second inlet conduit 120 extend from outside of the accumulator vessel 102 to inside of the accumulator vessel 102. A first outlet conduit 112 and a second outlet conduit 122 extend from inside of the accumulator vessel 102 to outside of the accumulator vessel 102. The first and second inlet conduits 110, 120 and the first and second outlet conduits 112, 122 extend through the same axial end of the accumulator vessel 102. Seals are provided where the first and second inlet conduits 110, 120 and the first and second outlet conduits 112, 122 pass through the cap 104.

Figure 2:
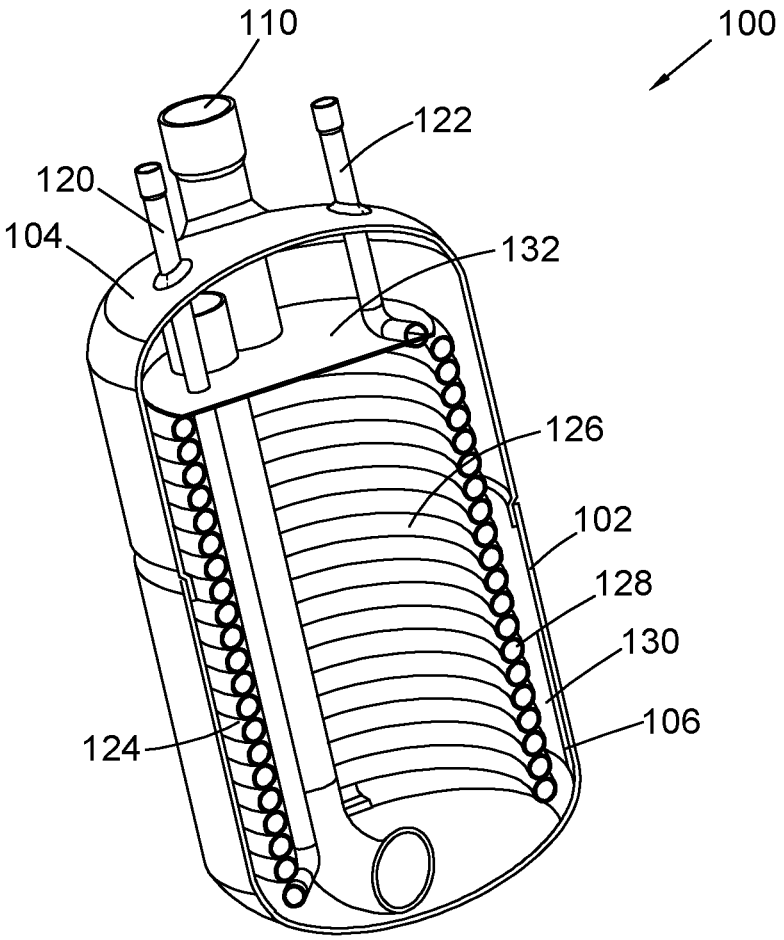
FIG. 2 shows a perspective view of a cross section of an accumulator heat exchanger in another plane parallel to the axis of the accumulator heat exchanger.

As seen in FIG. 2, a heat exchange coil 124 is provided within the accumulator vessel 102. The heat exchange coil 124 is in the form of a helical coil such that its outer surface defines a cylinder. The heat exchange coil 124 therefore encloses an axially extending inner volume 126. The heat exchange coil 124 is disposed within the accumulator vessel 102 so as to provide an axially extending outer gap 130 between the inner surface 106 of the accumulator vessel 102 and a radially outer surface 128 of the heat exchange coil 124. The outer gap 130 is annular in shape due to the cylindrical form of the accumulator vessel 102 and the heat exchange coil 124. The second inlet conduit 120 and the second outlet conduit 122 are connected to the heat exchange coil 124 so that the second inlet conduit 120 and the second outlet conduit 122 provide an inlet and outlet flow path for the heat exchange coil 124. In use, subcooled refrigerant flows from the second inlet conduit 120, through the heat exchange coil 124, and to the second outlet conduit 122. The second inlet conduit 120 and second outlet conduit 122 enter and exit, respectively, the accumulator vessel 102 through the same end.

A separator plate 132 is disposed within the accumulator vessel 102 so as to cover a cross section of the heat exchange coil 124. The separator plate 132 is disposed outside of the internal volume of the heat exchange coil 124 and in contact with an axial end of the heat exchange coil 124. The second inlet conduit 120 extends through the internal volume 126 of the heat exchange coil 124 in order to provide the inlet flow path for the heat exchange coil 124 such that, in use, refrigerant flows through the heat exchange coil from the axial end furthest from the separator plate towards the axial end adjacent the separator plate.

The first inlet conduit 110 extends from outside of the accumulator vessel 102, through a cap 104 of the accumulator vessel 102, through the separator plate 132 and to an outlet 114 (see FIG. 3) disposed within the inner volume 126 of the heat exchange coil 124. In use, refrigerant is therefore delivered to the inner volume 126 of the heat exchange coil 124 by the first inlet conduit 110. Liquid refrigerant will pool within the accumulator vessel 102, whereas gaseous refrigerant will flow to the first outlet conduit 112 to be removed from the accumulator vessel 102.

Figure 3:
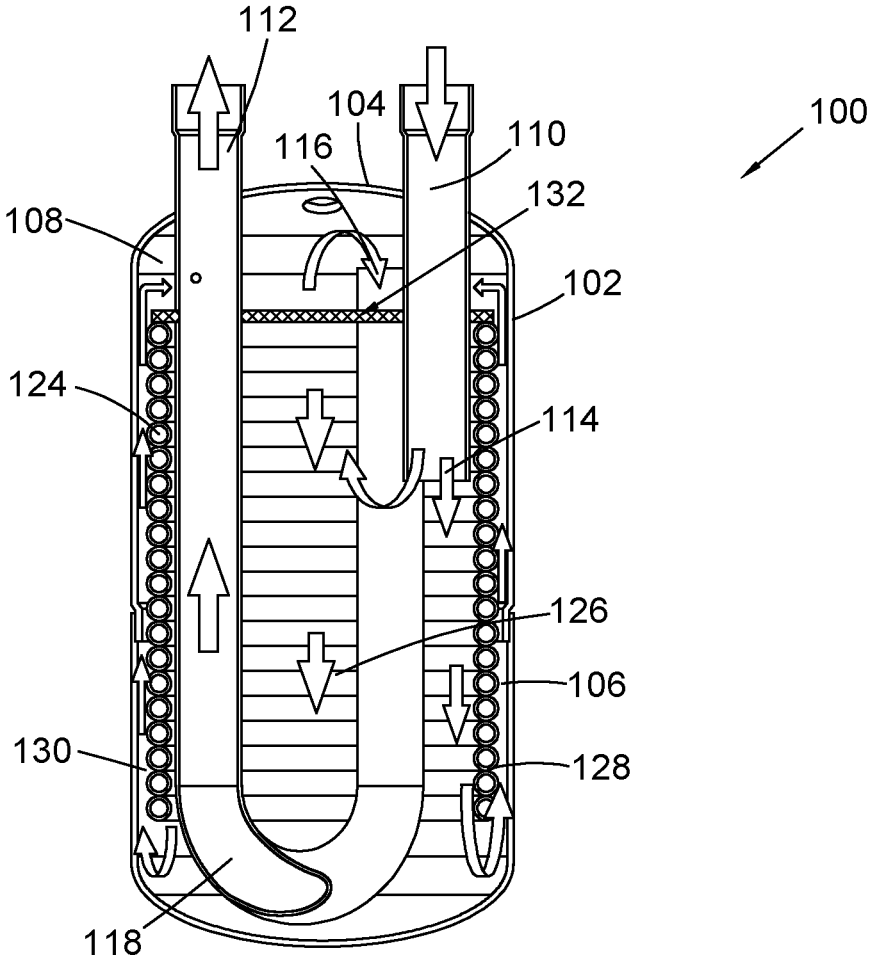
FIG. 3 shows a cross section of an accumulator heat exchanger in a plane parallel to the axis of the accumulator heat exchanger.

As shown in FIG. 3, the first outlet conduit 112 has an inlet 116 disposed outside of the inner volume 126 of the heat exchange coil 124 and on the opposite side of the separator plate 132 to the outlet of the first inlet conduit 114.

The configuration of the separator plate 132, the outlet of the first inlet conduit 114 and the inlet of the first outlet conduit 116 being on opposite sides of the separator plate 132, and the annular gap 130, creates a flow path for refrigerant which travels through the accumulator vessel 102 substantially along the length of the accumulator vessel at least twice.

In use, the refrigerant within the heat exchange coil 124 is at a higher temperature than the refrigerant within the first inlet conduit 110, internal volume of the accumulator vessel 108, and the first outlet conduit 112. Heat will therefore be transferred from the refrigerant within the heat exchange coil 124 to the refrigerant within the first inlet conduit 110, internal volume of the accumulator vessel 108, and the first outlet conduit 112. The refrigerant exiting the accumulator vessel 102 via the first outlet conduit 112 will therefore be at a higher temperature than the refrigerant entering the accumulator vessel 102 via the first inlet conduit 110. Accordingly, the refrigerant exiting the accumulator vessel 102 via the second outlet conduit 122 will be a lower temperature than the refrigerant entering the accumulator vessel 102 via the second inlet conduit 120.

The first outlet conduit 112 extends from the inlet 116, through the separator plate 132 and through the inner volume 126 of the heat exchange coil 124. In the example shown in FIGS. 3 and 4, once outside of the inner volume 126 of the heat exchange coil 124, the first outlet conduit 112 comprises a U turn 118 before extending back through the inner volume 126 of the heat exchange coil 124. Whilst within the inner volume 126 of the heat exchange coil 124 the first outlet conduit 112 is positioned adjacent to the heat exchange coil 124 so that, in use, heat exchange between the refrigerant within the first outlet conduit and the heat exchange coil is promoted. This is more clearly shown in FIGS. 5 and 6 where the first outlet conduit before and after the U turn 118 is shown in proximity to the heat exchange coil 124. The axis of each length of the first inlet conduit 112 that extends through the inner volume 126 of the heat exchange coil 124 is positioned closer to the windings than to the central axis of the coil 124.

In other examples, the first outlet conduit 112 does not comprise a U turn and the first outlet conduit 112 may instead extend along only one direction within the inner volume 126 of the heat exchange coil 124. In this case, the first outlet conduit 112 exits the accumulator vessel 102 at the opposite axial end to the end of the accumulator vessel 102 comprising the separator plate 132.

Figure 4:
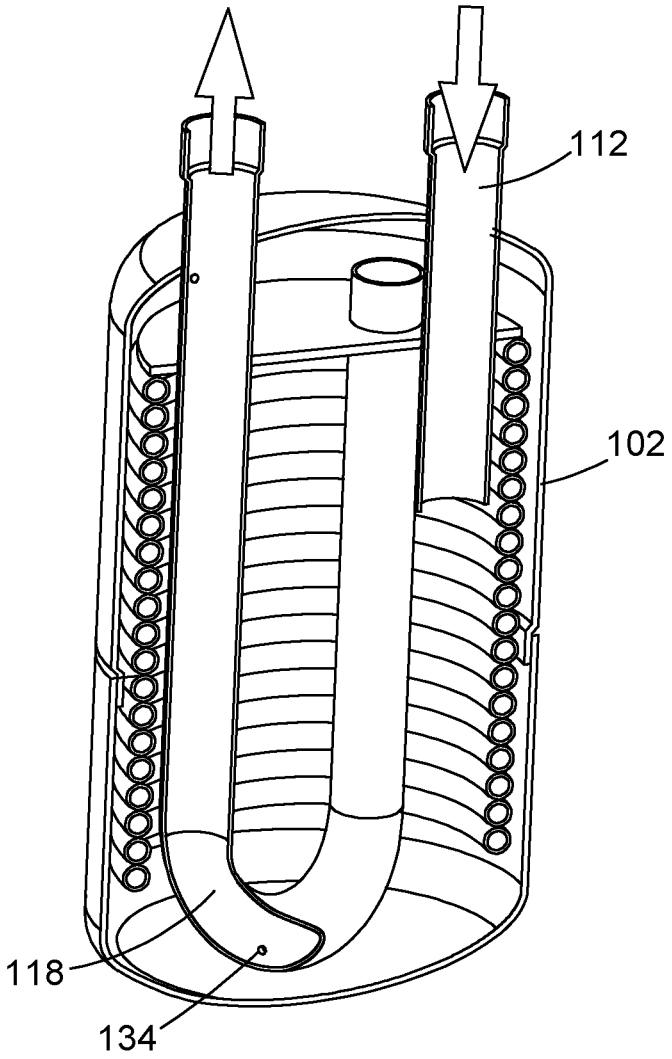
FIG. 4 shows a perspective view of a cross section of an accumulator heat exchanger.

FIG. 4 shows an example in which the first outlet conduit 112 comprises a U turn 118 and an oil port 134. When in use in the orientation shown in the figure, refrigerant oil will collect within the accumulator vessel 102 at the axial end in which the U turn 118 is located. When the level of the accumulated oil reaches the oil port 134, refrigerant oil will enter the first inlet conduit 112 through the oil port 134. In particular, the action of the refrigerant gas flowing through the first inlet conduit will cause the oil to become entrained within the flow in the first outlet conduit 112. In this way, refrigerant oil can be metered so that provision of the refrigerant oil to a compressor can be controlled. Use of the accumulator heat exchanger with such an oil port allows for provision of refrigerant oil to a compressor without also providing liquid refrigerant to the compressor.

Figure 5:
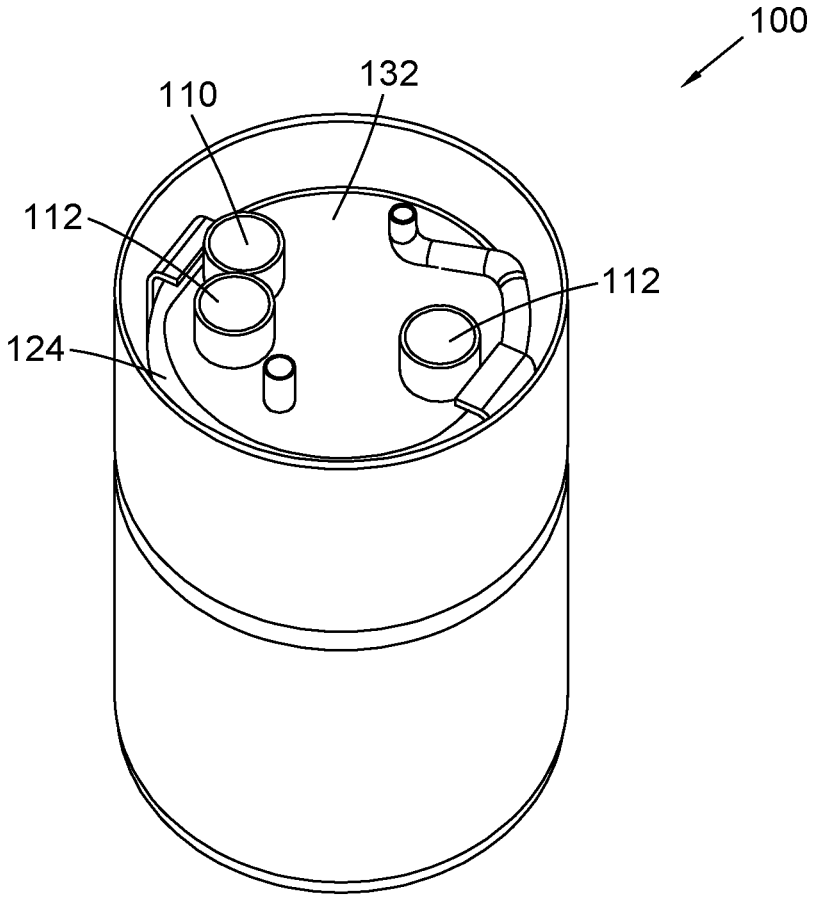
FIG. 5 shows a perspective view of a cross section of an accumulator heat exchanger in a plane perpendicular to the axis of the accumulator heat exchanger.

FIG. 5 shows an example in which the separator plate 132 is disposed within the inner volume of the heat exchange coil 124 and in contact with a radially inner surface of the heat exchange coil 124. The first inlet conduit 110 and the second inlet conduit 120 extend through the separator plate 132.

Figure 6:
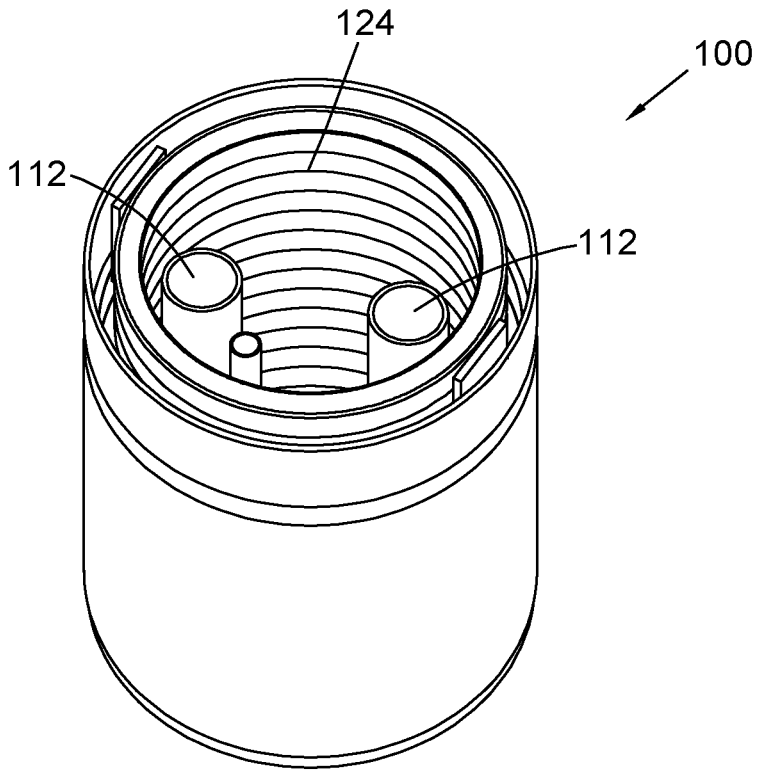
FIG. 6 shows a perspective view of a cross section of an accumulator heat exchanger in another plane perpendicular to the axis of the accumulator heat exchanger.

FIG. 6 shows at cross section of the accumulator vessel 102 perpendicular to the axis of the accumulator vessel 102 and at a point where the first inlet conduit 110 does not extend. At this cross section, only the first outlet conduit 112 and the second inlet conduit 120 are disposed within the inner volume 126 of the heat exchange coil 124.

Figure 7:
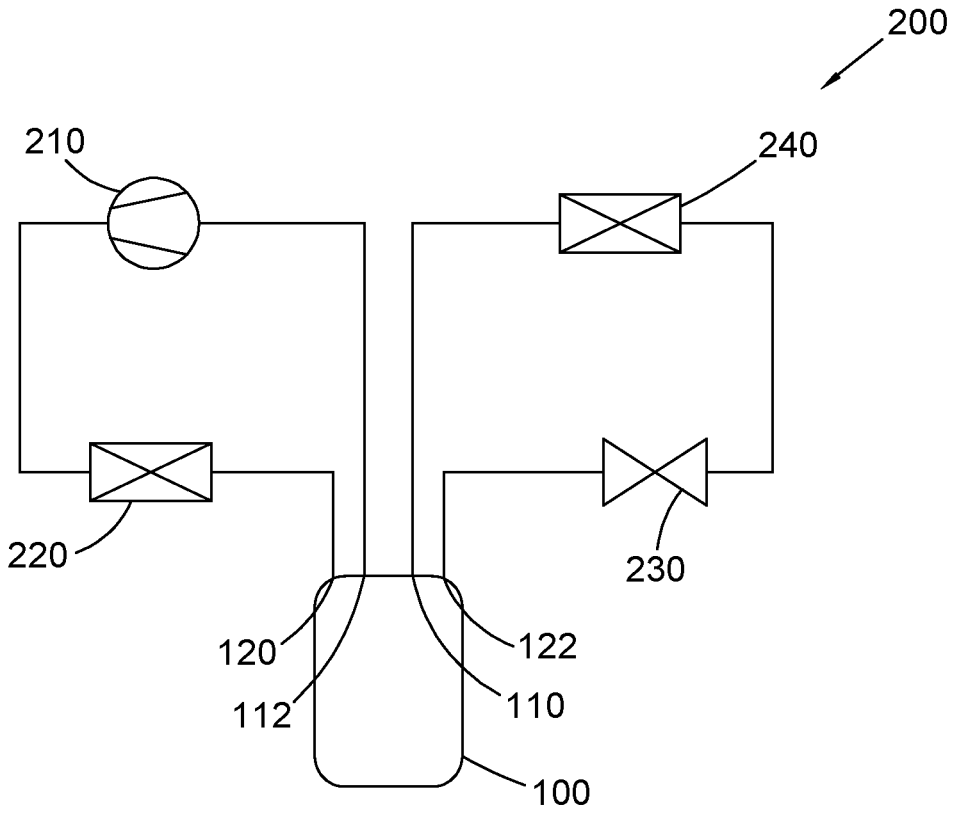
FIG. 7 shows a schematic view of a refrigeration system.

FIG. 7 shows a schematic of a refrigeration system 200 comprising the accumulator heat exchanger 100 described above. The refrigeration system 200 includes a compressor 210, a condenser 220, an expansion valve 230 and an evaporator 240. The condenser 220 is connected to the second inlet conduit 120 of the accumulator 100. The expansion valve 230 is connected to the second outlet conduit 112 of the accumulator 100.

Refrigerant flows sequentially from the compressor 210, to the condenser 220, to the heat exchange coil 124 within the accumulator heat exchanger 100, to the expansion valve 230, to the evaporator 240, to the first inlet and first outlet conduits 110, 112 of the accumulator heat exchanger 100 and back to the compressor 210.

The refrigerant that exits the condenser will be at a relatively high pressure (compared the refrigerant exiting the evaporator 240) and will be a liquid. The condenser 220 causes heat rejection from the refrigerant to the surroundings by cooling the refrigerant to its saturation temperature at which point the gaseous refrigerant condenses to a liquid. The latent heat evolved during the condensation is transferred to the surroundings. The condenser 220 may have a sufficient cooling capacity to reduce the temperature of the liquid to below the saturation temperature thereby producing subcooled refrigerant. The high pressure within the condenser 220 means that the saturation temperature of the refrigerant is greater than the saturation temperature of the refrigerant in the evaporator 240, which is at a lower pressure. The refrigerant temperature of the subcooled liquid refrigerant can hence be greater than the temperature of the gaseous refrigerant supplied by the evaporator 240. Heat is therefore transferred from the subcooled refrigerant in the heat exchange coil 124 to the gaseous refrigerant within the first inlet conduit 110, the accumulator internal volume 108 and the first outlet conduit 112.

The increased subcooling of the refrigerant exiting the second outlet conduit 122 in turn increases the cooling capacity of the refrigerant such that once it is supplied to the evaporator 240, an increased amount of heat is taken from the surroundings as the liquid evaporates to a gas. As a result, the efficiency of the refrigeration system is increased.

Providing heat to the refrigerant supplied to the accumulator vessel 102 via the first inlet conduit 110 will reduce the proportion of that refrigerant in the liquid phase. As a result, less liquid refrigerant accumulates in the accumulator and greater amounts of gaseous refrigerant is available to continue through the refrigeration system.

Use of the accumulator heat exchanger described above within this refrigeration system allows for these benefits to be achieved whilst avoiding increasing the complexity of the refrigeration system and increasing the space required for the refrigeration system. The refrigeration system and its use is therefore suited to applications such as transport refrigeration where the refrigeration system can be mounted to a vehicle or trailer in operative association with a cargo space within the vehicle or trailer for maintaining a controlled temperature environment within the cargo space.

The invention claimed is:

1. An accumulator heat exchanger for use within a refrigeration system, the accumulator heat exchanger comprising:

an accumulator vessel with an internal volume for accumulation of refrigerant fluid, wherein the accumulator vessel has an axial extent and a radial extent;

a first inlet conduit for gaseous refrigerant and a first outlet conduit for superheated gaseous refrigerant;

a heat exchange coil disposed within the accumulator vessel so as to provide an axially extending outer gap between an inner surface of the accumulator vessel and a radially outer surface of the heat exchange coil, wherein the heat exchange coil encloses an axially extending inner volume of the heat exchange coil;

a second inlet conduit for subcooled refrigerant fluid and a second outlet conduit for subcooled refrigerant fluid, wherein the second inlet conduit and second outlet conduit provide an inlet and outlet flow path for the heat exchange coil; and a separator plate covering a cross-section of the inner volume of the heat exchange coil without interrupting the outer gap, wherein:

the first inlet conduit extends from outside of the accumulator vessel into the accumulator vessel, through the separator plate and terminates at an internal outlet within the inner volume of the heat exchange coil on a side of the separator plate, the first outlet conduit has an internal inlet that is disposed within the accumulator vessel outside of the inner volume of the heat exchange coil and on an opposite side of the separator plate to the internal outlet of the first inlet conduit, wherein the first outlet conduit extends from the internal inlet through the separator plate and through the inner volume of the heat exchange coil and to the outside of the accumulator vessel, wherein the separator plate is brazed to the heat exchange coil.

2. The accumulator heat exchanger of claim 1, wherein a length of the first outlet conduit that extends within the inner volume of the heat exchange coil is disposed adjacent to the heat exchange coil.

3. The accumulator heat exchanger of claim 1, wherein the first outlet conduit comprises a U turn in order to extend axially through the inner volume of the heat exchange coil in opposite first and second directions.

4. The accumulator heat exchanger of claim 3, wherein the U turn is disposed outside of the inner volume of the heat exchange coil.

5. The accumulator heat exchanger of claim 3, wherein the first outlet conduit comprises an oil port for providing refrigerant oil from within the accumulator vessel to within the first outlet conduit.

6. The accumulator heat exchanger of claim 3, wherein the first inlet conduit and the first outlet conduit enter and exit the accumulator vessel, respectively, through a first cap of the accumulator vessel.

7. The accumulator heat exchanger of claim 1, wherein the pitch of the heat exchange coil is such that adjacent windings are in contact.

8. A refrigeration system comprising;

the accumulator heat exchanger of claim 1, a compressor, an evaporator, an expansion valve, and a condenser, wherein the first inlet conduit and the first outlet conduit are positioned between the evaporator and the compressor such that a first refrigerant flow path extends sequentially from the evaporator to the first inlet conduit, to the first outlet conduit to the compressor, and the second inlet conduit and second outlet conduit are positioned between the condenser and the expansion valve such that a second refrigerant flow path extends sequentially from the condenser to the second inlet conduit, to the second outlet conduit and to the expansion valve.

9. The refrigeration system of claim 8, wherein the first inlet conduit is directly connected to the evaporator.

10. The refrigeration system of claim 8, wherein the first outlet conduit is directly connected to the compressor.

11. A method of heat exchange using the accumulator heat exchanger of claim 1, the method comprising, simultaneously supplying gaseous refrigerant to the first inlet conduit, and supplying subcooled liquid refrigerant to the second inlet conduit.

12. The method of heat exchange according to claim 11, wherein the accumulator heat exchanger is part of a refrigeration system, wherein the refrigeration system comprises;

a compressor, an evaporator, an expansion valve, and a condenser, and the method of heat exchange comprises;

supplying refrigerant from the evaporator to the first inlet conduit, supplying superheated gaseous refrigerant from the first outlet conduit to the compressor, supplying the subcooled liquid refrigerant from the condenser to the second inlet conduit, and supplying the subcooled liquid refrigerant from the second outlet conduit to the expansion valve.

13. The method of heat exchange of claim 12, wherein gaseous refrigerant is supplied to the first inlet conduit directly from the evaporator.

14. The method of heat exchange of claim 12, wherein superheated gaseous refrigerant is supplied directly from the first outlet conduit to the compressor.

* * * * *